US008520013B2

(12) United States Patent
Bae et al.

(10) Patent No.: US 8,520,013 B2
(45) Date of Patent: Aug. 27, 2013

(54) DDC COMMUNICATION MODULE

(75) Inventors: Tae-Hoon Bae, Suwon (KR); Won-Seok Jung, Yongin (KR); Jong-Wook Kim, Seoul (KR)

(73) Assignee: Opticis Co., Ltd., Seongnam, Gyeonggi-Do (KR)

( * ) Notice: Subject to any disclaimer, the term of this patent is extended or adjusted under 35 U.S.C. 154(b) by 879 days.

(21) Appl. No.: 12/438,131

(22) PCT Filed: Aug. 21, 2007

(86) PCT No.: PCT/KR2007/003980

§ 371 (c)(1),
(2), (4) Date: Feb. 19, 2009

(87) PCT Pub. No.: WO2008/023914

PCT Pub. Date: Feb. 28, 2008

(65) Prior Publication Data

US 2010/0171747 A1 Jul. 8, 2010

(30) Foreign Application Priority Data

Aug. 21, 2006 (KR) ..... 10-2006-0078764

(51) Int. Cl.
*G06F 13/14* (2006.01)
*G06F 3/038* (2013.01)
*G09G 5/36* (2006.01)

(52) U.S. Cl.
USPC ..... 345/520; 345/556; 345/211

(58) Field of Classification Search
USPC ..... 345/520, 556, 211
See application file for complete search history.

(56) References Cited

U.S. PATENT DOCUMENTS

| | | | | |
|---|---|---|---|---|
| 7,009,616 | B2 | 3/2006 | Mendelson et al. | |
| 7,499,462 | B2 * | 3/2009 | MacMullan et al. | 370/401 |
| 7,612,772 | B2 * | 11/2009 | Tseng | 345/212 |
| 2003/0053172 | A1 | 3/2003 | Jung | |
| 2003/0214507 | A1 * | 11/2003 | Mawatari et al. | 345/530 |
| 2005/0116884 | A1 * | 6/2005 | Kim et al. | 345/11 |

FOREIGN PATENT DOCUMENTS

| | | | |
|---|---|---|---|
| KR | 1020030038086 | A | 5/2003 |
| KR | 1020040038233 | A | 5/2004 |

OTHER PUBLICATIONS

International Search Report, PCT/KR2007/003980, dated Dec. 3, 2007.

* cited by examiner

*Primary Examiner* — Hau Nguyen
(74) *Attorney, Agent, or Firm* — Nixon Peabody LLP

(57) ABSTRACT

Provided is a display data channel (DDC) communication module reading and storing extended display identification data (EDID) of a display device and providing the stored EDID to a host device. The DDC communication module includes: a serial electrically erasable and programmable read only memory (EEPFROM) in which the EDID is stored; a comparator outputting logic data indicating that the comparator is connected to the display device or the host device; and a controller reading and storing EDID, or providing EDID stored in the serial EEPROM to the host device, according to the logic data output from the comparator.

5 Claims, 6 Drawing Sheets

DDC COMMUNICATION MODULE

CROSS-REFERENCE TO RELATED PATENT APPLICATION

This application is a national phase of International Application No. PCT/KR2007/003980, entitled "DDC COMMUNICATION MODULE", which was filed on Aug. 21, 2007, and which claims priority of Korean Patent Application No. 10-2006-0078764, filed on Aug. 21, 2006 in the Korean Intellectual Property Office, the disclosure of which is incorporated herein in its entirety by reference.

BACKGROUND OF THE INVENTION

1. Technical Field

The present invention relates to a display data channel (DDC) communication module, and more particularly, to a DDC communication module adopting an inter-integrated circuit ($I^2C$) communication protocol.

2. Background Art

A display data channel (DDC) communication module employing an inter-integrated circuit ($I^2C$) is disclosed in U.S. Patent Publication No. 2003-0053172 lodged by the present applicant, entitled "Optical Communication Interface Module Connected to Electrical Communication Interface Module of $I^2C$ Communication Protocol".

FIG. 1 is a timing diagram for explaining an $I^2C$ communication protocol.

Referring to FIG. 1, the $I^2C$ communication protocol is a protocol for performing serial communication using only two channels, that is a channel for a serial data signal SDA and a channel for a serial clock signal SCL, without a channel for a control signal, unlike a conventional serial communication protocol. According to the $I^2C$ communication protocol, whenever the serial clock signal SCL is a logic level '1' (a high voltage level), the state of the serial data signal SDA is set.

A time t1 at which the serial data signal SDA falls from a logic level '1' to a logic level '0' (a low voltage level), while the serial clock signal SCL is a logic level '1', is a starting time of a data packet. A time t14 at which the serial data signal SDA rises from a logic level '0' to a logic level '1', while the serial clock signal SCL is a logic level '1 (a high voltage level), is a terminating time of the data packet. Accordingly, in the period between t1 and t14 during which the data package is transmitted, the serial data signal SDA must not undergo logic transition while the corresponding serial clock signal SCL is a logic level '1', Data with a logic level '1', data with a logic level '0', data with a logic level '0', data with a logic level '1', data with a logic level '1', and data with a logic level '0' are sequentially transmitted or received, respectively, for the duration between t2 and t3, for the duration between t4 and t5, for the duration between t10 and t11, and for the duration between t12 and t13, in which the serial clock signal SCL is a logic level '1'.

FIG. 2 is a block diagram of a conventional digital visual interface (DVI) system DVI including a conventional DDC communication module DDC. Referring to FIG. 2, the conventional DVI system DVI includes: a host device 21 including a transition minimized differential signaling (TMDS) transmitter 211 and a graphics controller 212; TMDS communication lines TMDS; the conventional DDC communication module DDC; and a display device 22 including a TMDS receiver 221 and a serial electrically erasable and programmable read only memory EEPROM 222.

Extended display identification data (EDID), which contains information on the configuration and characteristics of the display device 22, is stored in the serial EEPROM 222 of the display device 22. According to rules of the video electronics standard association (VESA), an 8-bit access address of the serial EEPROM 222 of the display device 22 is "1010000x". That is, the access address of the serial EEPROM 222 of the display device 22 is "10100001" in a read mode and "10100000" in a write mode.

The graphics controller 212 of the host device 21 reads the EDID stored in the serial EEPROM 222 of the display device 22 through $I^2C$ communication, and controls the operation of the TMDS transmitter 211 according to the read EDID. Accordingly, the TMDS transmitter 211 transmits image signals and clock signals to the TMDS receiver 221 via the TMDS communication lines TMDS.

The conventional DDC communication module DDC includes $I^2C$ interfaces EI1 and EI2, a serial data transmitting/receiving line $TL_D$, a serial clock transmitting/receiving line $TL_C$, a DDC power line between power terminals $V_D$, and a connection state line between interface signal terminals HPD.

The $I^2C$ interfaces EI1 and EI2 connected to the serial data transmitting/receiving line $TL_D$ respectively transmit serial data from serial data output terminals $SDA1_{OUT}$ and $SDA2_{OUT}$ to the opposite $I^2C$ interfaces EI1 and EI2 via the serial data transmitting/receiving line $TL_D$, and respectively input serial data from the serial data transmitting/receiving line $TL_D$ to serial data input terminals $SDA1_{IN}$ and $SDA2_{IN}$.

Likewise, the I2C interfaces EI1 and EI2 connected to the serial clock transmitting/receiving line $TL_C$ respectively transmit clock signals from serial clock output terminals $SCL1_{OUT}$ and $SCL2_{OUT}$ to the opposite $I^2C$ interfaces EI1 and EI2 via the serial clock transmitting/receiving line $TL_C$, and respectively input clock signals from the serial clock transmitting/receiving line $TL_C$ to serial clock input terminals $SCL1_{IN}$ and $SCL2_{IN}$.

The graphics controller 212 supplies a direct current (DC) voltage via the DDC power line between the power terminals $V_D$.

Since data with a logic level "1" is applied to the HPD while the display device 22 is operated, the graphics controller 212 of the host device 21 can determine whether the host device 21 is connected to the display device 22.

EDID defined by a standard published by VESA will now be explained with reference to FIG. 3. FIG. 3 is a block diagram of EDID defined by a standard of VESA.

Referring to FIG. 3, EDID includes 13 items I1 through I13.

In areas with addresses 000h through 007h, a header is stored as the first item I1.

In areas with addresses 008h through 011h, product identification (ID) is stored as the second item.

In areas with addresses 012h through 013h, the EDID structure version is stored as the third item I3.

In areas with addresses 014h through 018h, basic display parameters/characteristics are stored as the fourth item I4.

In areas with addresses 019h through 022h, color characteristics are stored as the fifth item I5.

In areas with addresses 023h through 025h, established timings are stored as the sixth item I6.

In areas with addresses 026h through 034h, standard timing ID is stored as the seventh item I7.

In areas with addresses 035h through 047h, a first detailed timing description or a monitor descriptor is stored as the eighth item I8.

In areas with addresses 048h through 059h, a second detailed timing description or a monitor descriptor is stored as the ninth item I9.

In areas with addresses 05Ah through 06Bh, a third detailed timing description or a monitor descriptor is stored as the tenth item I10.

In areas with addresses 06Ch through 07Dh, a fourth detailed timing description or a monitor descriptor is stored as the eleventh item I11.

In an area with an address 07Eh, an extension flag is stored as the twelfth item I12.

In an area with an address 07Fh, a checksum is stored as the thirteenth item I13.

However, the conventional DDC communication module DDC of FIG. 2 has problems of noise and signal attenuation in long range communication.

DETAILED DESCRIPTION OF THE INVENTION

Technical Problem

The present invention provides a display data channel (DDC) communication module that can prevent noise and signal attenuation in long range communication.

Technical Solution

According to an aspect of the present invention, there is provided a DDC communication module reading and storing extended display identification data (EDID) of a display device and providing the stored EDID to a host device, the DDC communication module comprising: a serial electrically erasable and programmable read only memory (EEPROM), a comparator, and a controller.

The EEPROM allows the EDID to be stored therein.

The comparator outputs logic data indicating that the comparator is connected to the display device or the host device.

The controller reads and stores EDID, or provides EDID stored in the serial EEPROM to the host device, according to the logic data output from the comparator.

When the DDC communication module is connected to a DDC port of the display device by a user's operation, EDID stored in the display device may be read and stored in the DDC communication module.

Also, when the DDC communication module is connected to a DDC port of the host device by a user's operation, EDID stored in the DDC communication module may be read and stored in the host device.

Advantageous Effects

Accordingly, the DDC communication module can overcome the problems of noise and signal attenuation in long range communication. Furthermore, since no cable for DDC communication is necessary, the DDC communication module is economical.

MODE OF THE INVENTION

The present invention will now be described more fully with reference to the accompanying drawings, in which exemplary embodiments of the invention are shown.

Figure 4:
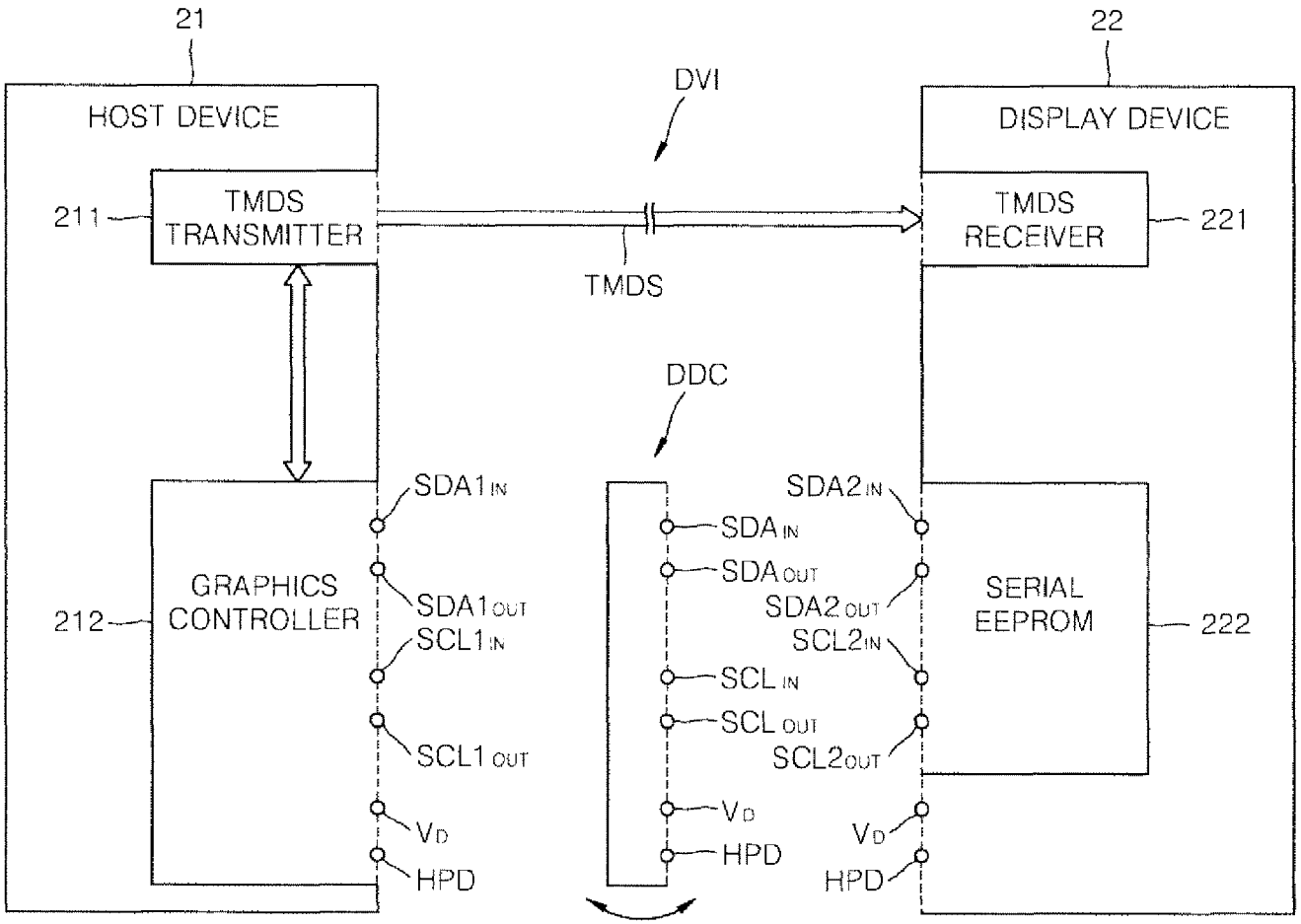
FIG. 4 is a block diagram of a DVI system including a DDC communication module, according to an embodiment of the present invention.
Figure 5:
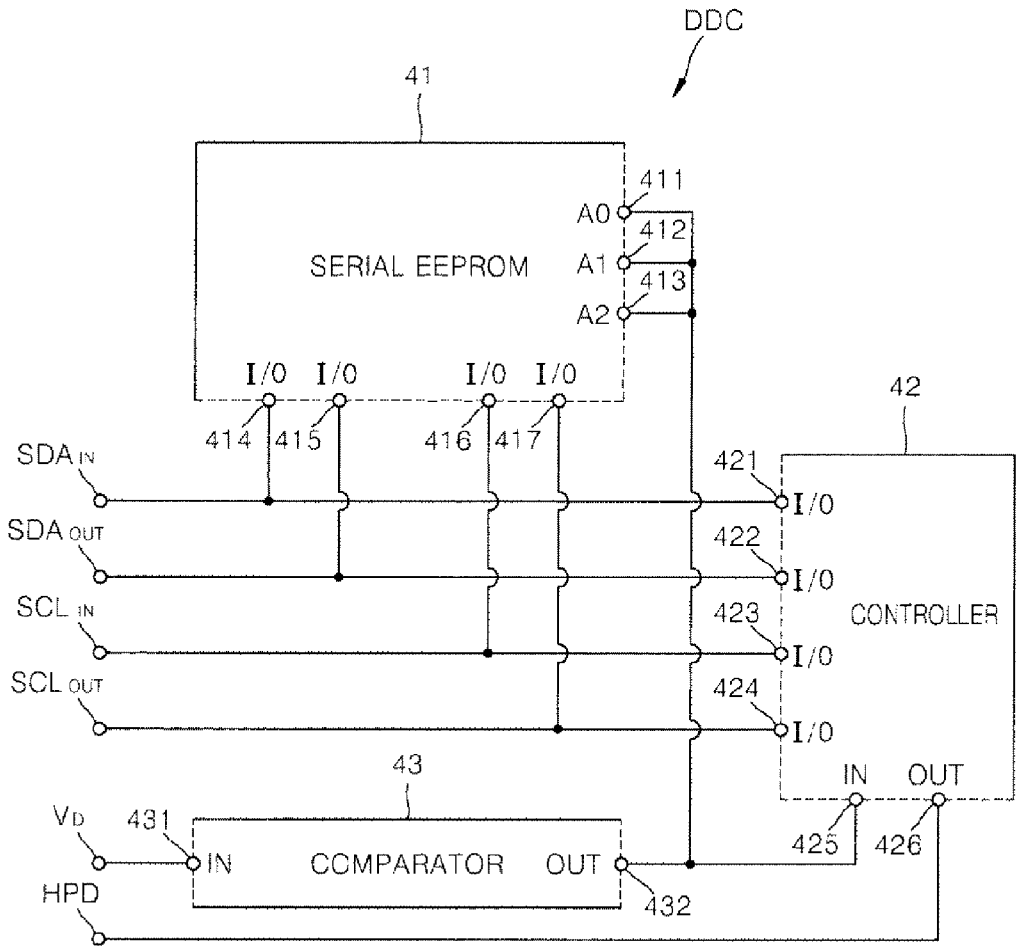
FIG. 5 is a block diagram illustrating the configuration of the DDC communication module of the DVI system of FIG. 4, according to an embodiment of the present invention.

FIG. 4 is a block diagram of a digital visual interface (DVI) system DVI including a display data channel (DDC) communication module DDC according to an embodiment of the present invention. FIG. 5 is a block diagram illustrating the configuration of the DDC communication module DDC of the DVI system DVI of FIG. 4, according to an embodiment of the present invention.

Figure 1:
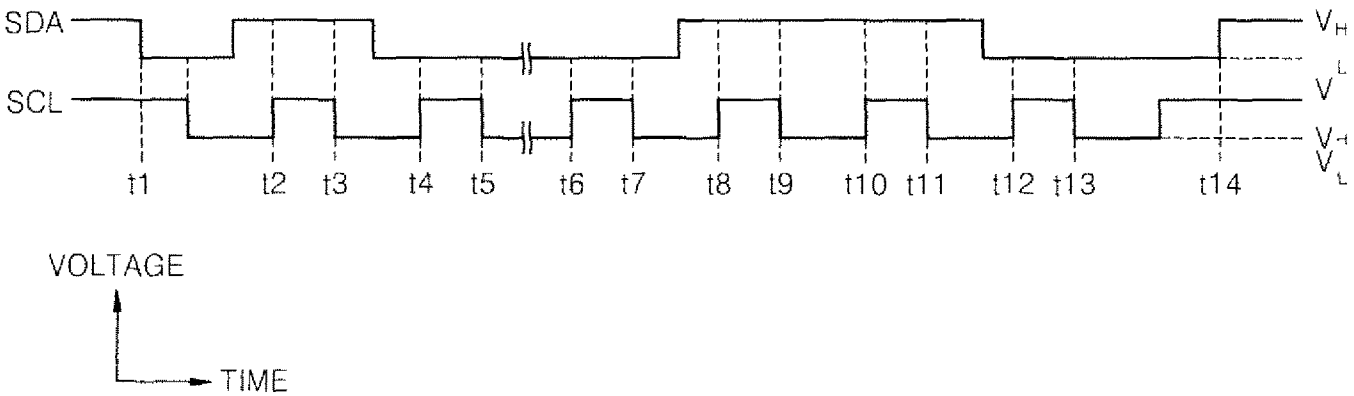
FIG. 1 is a timing diagram for explaining an inter-integrated circuit ($I^2C$) communication protocol.
Figure 2:
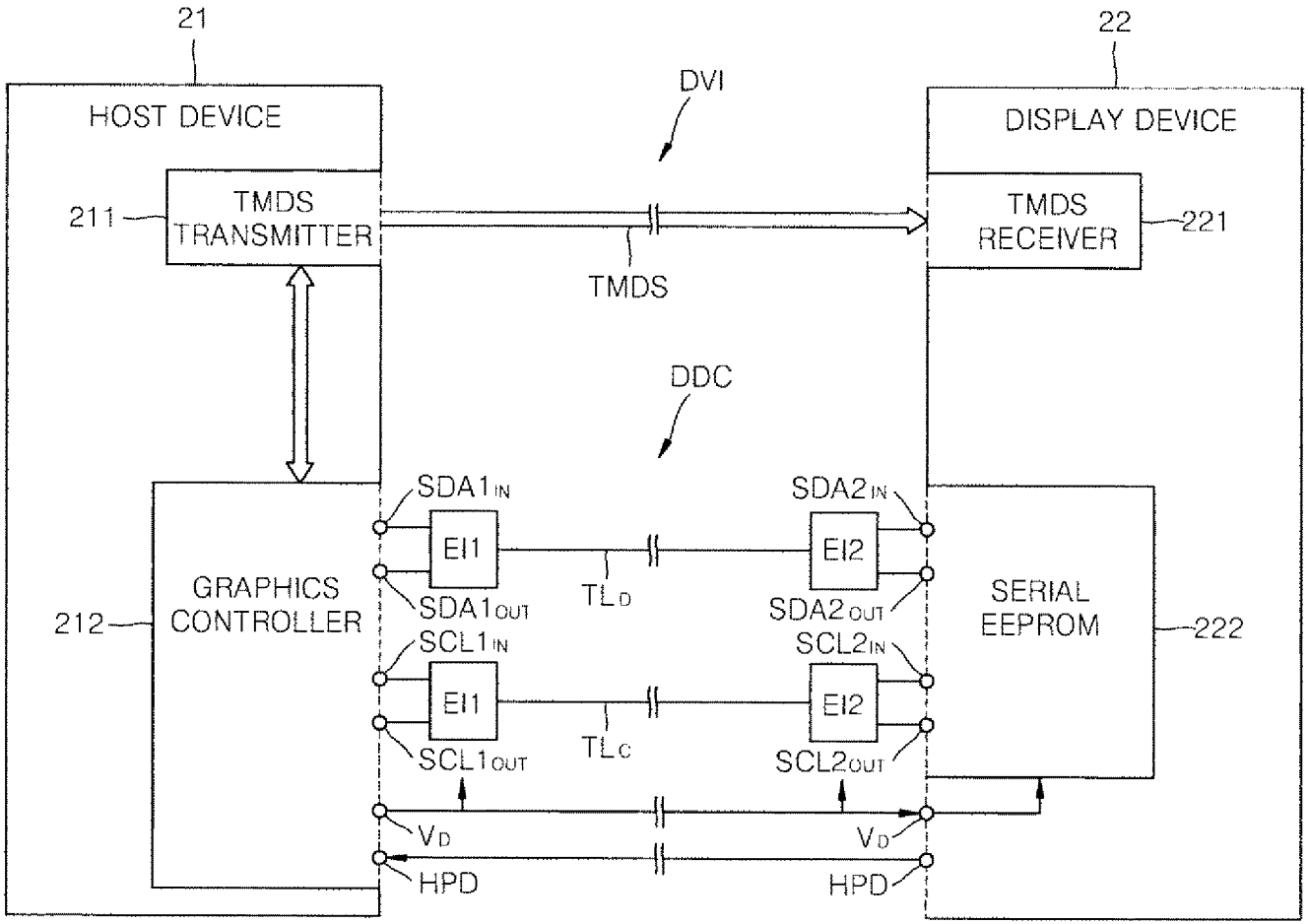
FIG. 2 is a block diagram of a digital visual interface (DVI) system including a conventional display data channel (DDC) communication module.

Since the DVI system DVI of FIG. 4 is the same as the DVI system DVI of FIG. 2 except the DDC communication module DDC, a detailed explanation thereof will not be given.

Figure 3:
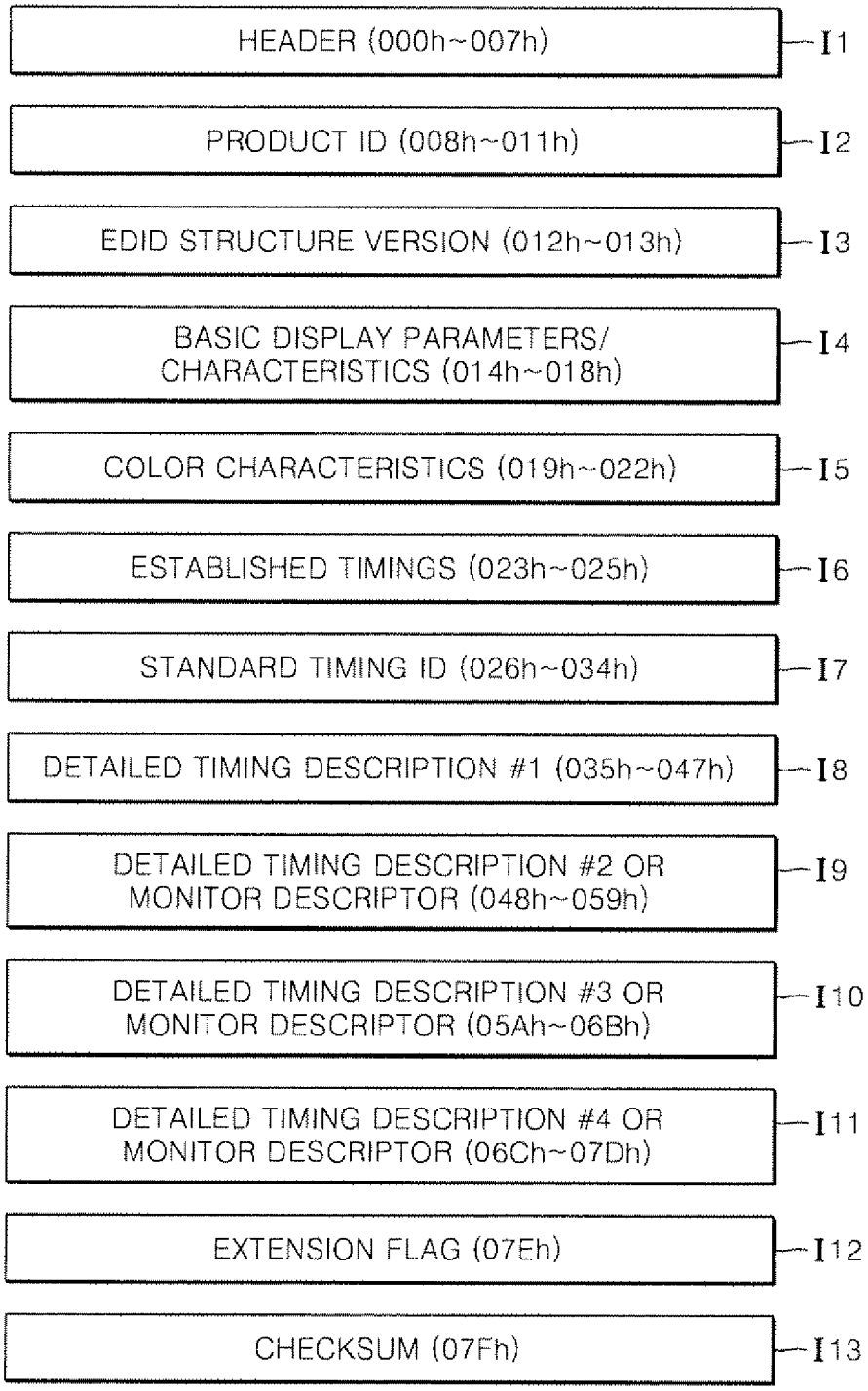
FIG. 3 is a block diagram of extended display identification data (EDID) defined by a standard of the video electronics standards association (VESA).

Referring to FIGS. 4 and 5, the DDC communication module DDC reads and stores extended display identification data (EDID) stored in a serial electrically erasable and programmable read only memory (EEPROM) 222 of a display device 22 (see FIG. 3), and provides the stored EDID to a host device 21.

The DDC communication module DDC includes a serial EEPROM 41, a comparator 43, and a controller 42.

EDID is stored in the serial EEPROM 41. When 8 bits of an access address of the serial EEPROM 41 are first through eighth bits in ascending order, reference marks A0, A1, and A2 denote terminals setting the second through fourth bits.

As described above, according to rules of the video electronics standards association (VESA), an 8-bit access address of the serial EEPROM 222 of the display device 22 is "1010000x". That is, the access address of the serial EEPROM 222 of the display device 22 is "10100001" in a read mode and "10100000" in a write mode.

Accordingly, when the DDC communication module DDC is connected to a DDC port of the display device 22 by a user's operation, in order for EDID stored in the serial EEPROM 222 of the display device 22 to be read and stored in the serial EEPROM 41 of the DDC communication module DDC, an access address of the serial EEPROM 41 of the DDC communication module DDC should be different from that of the serial EEPROM 222 of the display device 22.

Also, when the DDC communication module DDC is connected to a DDC port of a host device 21 by a user's operation, in order for EDID stored in the DDC communication module DDC to be provided to the host device 21, the access address of the serial EEPROM 41 of the DDC communication module should be the same as that of the serial EEPROM 222 of the display device 22.

The comparator 43 outputs logic data indicating that the comparator 43 is connected to the display device 22 or the host device 21.

Potentials applied to DDC power terminals $V_D$ of all display devices 22 range from 0 to 2 V, and potentials applied to DDC power terminals $V_D$ of all host devices 21 range from 4 to 5 V. The comparator 43 outputs data with a logic level "1" when connected to a DDC power terminal $V_D$ of the display device 22, and outputs data with a logic level "0" when connected to a DDC power terminal $V_D$ of the host device 21.

Accordingly, when the comparator 43 is connected to the DDC power terminal $V_D$ of the display device 22, an access address of the serial EEPROM 41 becomes "1010111x" due to the data with the logic level "1". That is, since the access address of the serial EEPROM 41 becomes "10101111" in a read mode and "10101110" in a write mode, the access address of the serial EEPROM 41 is different from a standard access address "1010000x" of the serial EEPROM 222 of the display device 22.

On the contrary, when the comparator 43 is connected to the DDC power terminal $V_D$ of the host device 21, an access address of the serial EEPROM 41 becomes "1010000x" due to the data with the logic level "0". That is, since an access address of the serial EEPROM 41 becomes "10100001" in a read mode and "10100000" in a write mode, the access address of the serial EEPROM 41 is the same as the standard access address "1010000x" of the serial EEPROM 222 of the display device 22.

Accordingly, the controller 42 reads and stores EDID in the serial EEPROM 41, or provides EDID stored in the serial EEPROM 41 to the host device 21 according to logic data output from the comparator 43.

Accordingly, when the DDC communication module DDC is connected to the DDC port of the display device 22 by a user's operation, EDID stored in the display device 22 is read and stored in the DDC communication module DDC.

Also, when the DDC communication module DDC is connected to the DDC port of the host device 21 by a user's operation, EDID stored in the DDC communication module DDC is provided to the host device 21.

The DDC communication module DDC of FIGS. 4 and 5 can overcome the problems of noise and signal attenuation in long range communication. Also, since no cable for DDC communication is necessary, the DDC communication module DDC of FIGS. 4 and 5 is economical.

Figure 6:
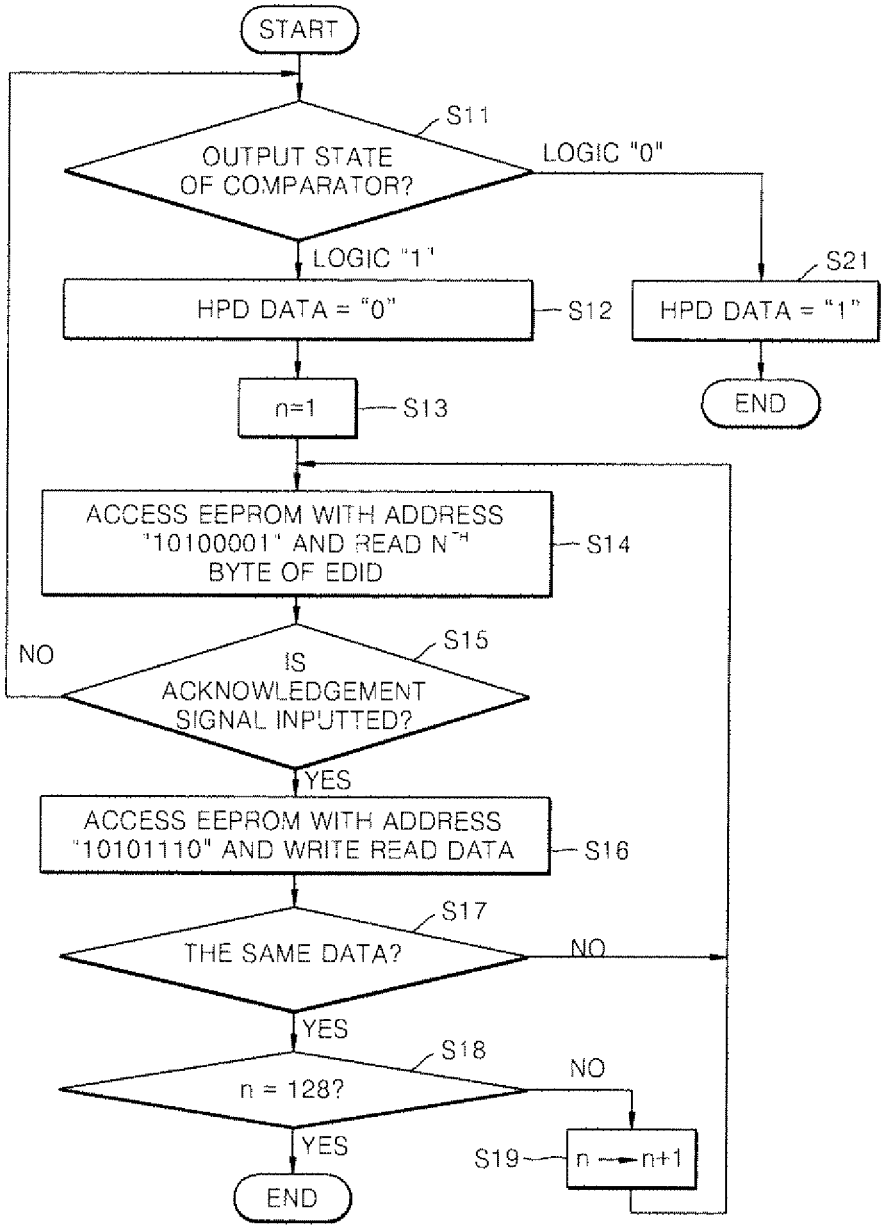
FIG. 6 is a flowchart illustrating an algorithm of a controller of the DDC communication module of FIG. 5, according to an embodiment of the present invention.

An algorithm of the controller 42 of the DDC communication module DDC of FIG. 5 will now be explained with reference to FIGS. 4 through 6. FIG. 6 is a flowchart illustrating an algorithm of the controller 42 of the DDC communication module of FIG. 5, according to an embodiment of the present invention In operation S11, the controller 42 determines whether the comparator 43 outputs data with a logic level "0" or "1".

When the DDC communication module DDC is connected to the DDC port of the display device 22 and thus the comparator 43 outputs data with a logic level "1", the controller 42 operates as follows.

In operation S12, the controller 42 applies a data signal with a low logic level "0" to interface signal terminals "HPD".

In operation S13, the controller 42 sets a read count variable n to 1.

In operation S14, the controller 42 accesses the serial EEPROM 222 of the display device 22 with an address "10100001", and reads an $n^{th}$ byte of EDID.

In operation S15, the controller 42 determines whether an acknowledgement signal is input from the display device 22.

If it is determined in operation S15 that an acknowledgement signal is not input from the display device 22, the controller 42 returns to operation S11.

If it is determined in operation S15 that an acknowledgement signal is input from the display device 22, the controller 42 operates as follows.

In operation S16, the controller 42 accesses the serial EEPROM 41 of the DDC communication module DDC with an address "10101110", and writes the read data.

In operation S17, the controller 42 determines whether the read data is the same as the written data. If it is determined in operation S17 that the read data is not the same as the written data, the process returns to operation S14.

If it is determined in operation S17 that the read data is the same as the written data, the process goes to operation S18. In operation S18, the controller 42 determines whether the read count variable n is 128 that is a final value.

If it is determined in operation S18 that the read count variable n is not 128, the process goes to operation S19. In operation S19, the read count variable n is increased by 1 and the process returns to operation S14.

If it is determined in operation S18 that the read count variable n is 128, read and write operations of the controller 42 end.

According to operations S11 through S19, when the DDC communication module DDC is connected to the DDC port of the display device 22 by a user's operation, EDID stored in the serial EEPROM 222 of the display device 22 is read and stored in the serial EEPROM 41 of the DDC communication module DDC.

On the contrary, in operation S12, when the DDC communication module DDC is connected to the DDC port of the host device 21 and thus the comparator 43 outputs data with a logic level "0", the controller 42 applies a data signal with a logic high level "1" to the interface signal terminals "HPD".

As described above, when the comparator 43 is connected to the DDC power terminal $V_D$ of the host device 21, an access address of the serial EEPROM 41 of the DDC communication module DDC becomes "1010000x" due to the data with the logic level "0". That is, since an access address of the serial EEPROM 41 of the DDC communication module DDC becomes "10100001" in a read mode and "10100000" in a write mode, the access address of the serial EEPROM 41 of the DDC communication module DDC is the same as the standard access address of the serial EEPROM 222 of the display device 22.

Accordingly, the graphics controller 212 of the host device 21 receives EDID stored in the serial EEPROM 41 of the DDC communication module DDC and can control the TMDS transmitter 211 of the host device 21 according to the received EDID. Of course, the graphics controller 212 of the host device 21 can use the same communication method with the display device 22.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, a switch manually operated by a user may function as the comparator 43.

INDUSTRIAL APPLICABILITY

As described above, the DDC communication module according to the present invention can overcome the problems of noise and signal attenuation in long range communication. Also, since no cable for DDC communication is necessary, the DDC communication module according to the present invention is economical.

The invention claimed is:

1. A display data channel (DDC) communication module operable to read and store extended display identification data (EDID) from a memory of a display device and provide the stored EDID to a host device, the DDC communication module comprising:

a serial electrically erasable and programmable read only memory (EEPROM) operable to store the EDID read from the memory of a display device;

a comparator operable to provide a logical output having a first state that indicates connection to a power terminal of the display device and having a second state, different from the first state, that indicates connection to a power terminal of the host device; and a controller operable to read and store the EDID, or providing EDID stored in the serial EEPROM to the host device, according to the logical output state of the comparator.

2. The DDC communication module of claim 1, wherein the comparator comprises an input terminal which is connected to a DDC power terminal of the display device or the host device by a user.

3. The DDC communication module of claim 2, wherein the comparator outputs data with a logic level "1" when connected to the DDC power terminal of the display device, and outputs data with a logic level "0" when connected to the DDC power terminal of the host device.

4. The DDC communication module of claim 3, wherein, when the comparator is connected to the DDC power terminal of the display device, an access address of the serial EEPROM of the DDC communication module is different from a standard access address of a serial EEPROM of the display device due to the data with the logic level "1".

5. The DDC communication module of claim 4, wherein, when the comparator is connected to the DDC power terminal of the host device, an access address of the serial EEPROM of the DDC communication module is the same as a standard access address of the serial EEPROM of the display device due to the data with the logic level "0".

* * * * *

UNITED STATES PATENT AND TRADEMARK OFFICE

CERTIFICATE OF CORRECTION

PATENT NO. : 8,520,013 B2
APPLICATION NO. : 12/438131
DATED : August 27, 2013
INVENTOR(S) : Bae et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 940 days.

Signed and Sealed this
Fifteenth Day of September, 2015

Michelle K. Lee

Michelle K. Lee
*Director of the United States Patent and Trademark Office*